US011448371B2

(12) United States Patent
Hunt et al.

(10) Patent No.: US 11,448,371 B2
(45) Date of Patent: Sep. 20, 2022

(54) LIGHTING DEVICE POWER CONTROL CIRCUIT SYSTEMS AND METHODS

(71) Applicant: SureFire, LLC, Fountain Valley, CA (US)

(72) Inventors: William A. Hunt, Foothill Ranch, CA (US); William D. Wells, Costa Mesa, CA (US)

(73) Assignee: SureFire, LLC, Fountain Valley, CA (US)

( * ) Notice: Subject to any disclaimer, the term of this patent is extended or adjusted under 35 U.S.C. 154(b) by 369 days.

(21) Appl. No.: 16/656,369

(22) Filed: Oct. 17, 2019

(65) Prior Publication Data

US 2021/0116079 A1 Apr. 22, 2021

(51) Int. Cl.

| | |
|---|---|
| ***H05B 45/38*** | (2020.01) |
| ***F21L 4/00*** | (2006.01) |
| ***F21V 23/04*** | (2006.01) |
| ***F21L 4/08*** | (2006.01) |
| ***F21V 25/04*** | (2006.01) |
| ***F21V 23/02*** | (2006.01) |
| ***H05B 45/37*** | (2020.01) |

(52) U.S. Cl.

CPC ..... *F21L 4/005* (2013.01); *F21L 4/085* (2013.01); *F21V 23/023* (2013.01); *F21V 23/0421* (2013.01); *F21V 25/04* (2013.01); *H05B 45/37* (2020.01); *H05B 45/38* (2020.01)

(58) Field of Classification Search

CPC ..... F21L 4/005; F21L 4/085; F21V 23/023; F21V 23/0421; F21V 25/04; H05B 45/37; H05B 45/38; H05B 45/50; H05B 47/25

See application file for complete search history.

(56) References Cited

U.S. PATENT DOCUMENTS

| | | | | |
|---|---|---|---|---|
| 7,800,313 | B1 * | 9/2010 | Allen | H05B 45/38 315/200 A |
| 8,096,674 | B2 | 1/2012 | Matthews et al. | |
| 2004/0140771 | A1 * | 7/2004 | Kim | F21V 23/02 315/86 |
| 2012/0133205 | A1 * | 5/2012 | Adams | H05B 45/46 307/29 |

* cited by examiner

*Primary Examiner* — Seokjin Kim

(74) *Attorney, Agent, or Firm* — Haynes and Boone, LLP

(57) ABSTRACT

A lighting device power control circuit configured to charge one or more capacitors through the pulsing of an inductor is provided. In one example, a lighting device includes a light source and a power control circuit. The power control circuit comprises an inductor, a power transistor configured to pass an operating current associated with the light source, and one or more capacitors configured to keep the power transistor turned on to pass the operating current. The one or more capacitors are configured to be periodically charged in response to a voltage spike generated across the inductor. Related methods and additional embodiments are also provided.

20 Claims, 13 Drawing Sheets

LIGHTING DEVICE POWER CONTROL CIRCUIT SYSTEMS AND METHODS

TECHNICAL FIELD

This disclosure relates to lighting devices in general, and more particularly to switches for portable lighting devices.

BACKGROUND

Portable lighting devices such as flashlights are typically equipped with user operable controls such as switches to selectively turn on and off light sources. In some cases, switches may be provided at locations that are remote from a power source and/or other electronics of the lighting device. For example, a switch may be located in the tailcap of a flashlight to permit a user to conveniently actuate the switch with a thumb without interfering with the user's grasp of the flashlight body. In such implementations, the flashlight may be provided with the light source located at the front (e.g., head end), a battery in the middle (e.g., intermediate portion held by the user), and the switch in the tailcap.

This remote positioning of the switch relative to other components can complicate the physical implementation of electrical circuits of the lighting device. For example, in some cases, one or more additional circuit paths may be required to be provided between the tailcap switch and other electrical components in the head end of the flashlight. To accommodate such circuit paths, a conductive sleeve may be disposed between the flashlight housing and the battery. Unfortunately, such sleeves add weight and can require the flashlight housing to increase in size (e.g., resulting in potentially undesirable extra bulk) and/or require the battery to decrease in size (e.g., resulting in potentially less available power storage available).

In other cases, to avoid the above-noted drawbacks resulting from adding additional circuit paths, the switch may be implemented as a mechanical switch electrically connected to the flashlight body. In such implementations, the switch may provide the ground path for the light source, thus requiring the switch to pass the electrical current used to drive the light source. Unfortunately, this can be problematic for many high power implementations, such as light sources capable of capable of providing 1500 lumens using drive currents of 5 Amps. In particular, some lightweight mechanical switches may not be able to sustain high currents for longer than several minutes without suffering breakdown (e.g., through melting, circuit failure, or other faults). Moreover, mechanical switches capable of sustaining such currents may require the use of specialized materials and/or larger sized components, all of which can add prohibitive weight and cost and require users to exert large amounts of force to physically operate the switches.

SUMMARY

In one embodiment, a lighting device includes a light source; and a power control circuit comprising: an inductor, a power transistor configured to pass an operating current associated with the light source, and one or more capacitors configured to keep the power transistor turned on to pass the operating current, wherein the one or more capacitors are configured to be periodically charged in response to a voltage spike generated across the inductor.

A method includes activating a light source of a lighting device comprising: the light source, and a power control circuit comprising an inductor, a power transistor, and one or more capacitors; passing, by the power transistor, an operating current associated with the light source; periodically generating a voltage spike across the inductor; and charging the one or more capacitors in response to the voltage spike to keep the power transistor turned on to continue the passing.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

In accordance with various embodiments set forth herein, a lighting device may be provided with a power control circuit including a user operable switch (e.g., a mechanical switch), a power transistor, and an inductor. The inductor may be periodically pulsed by connecting and disconnecting a voltage source (e.g., a battery) across the inductor to cause a voltage spike to appear across the inductor. This voltage spike may be rectified and captured by one or more capacitors used to drive a gate of the power transistor which passes substantial current (e.g., up to approximately 5 Amps or 6 Amps) associated with a light source of the lighting device. As a result, the current associated with a high power light source is not required to pass through the user operable mechanical switch.

Figure 1:
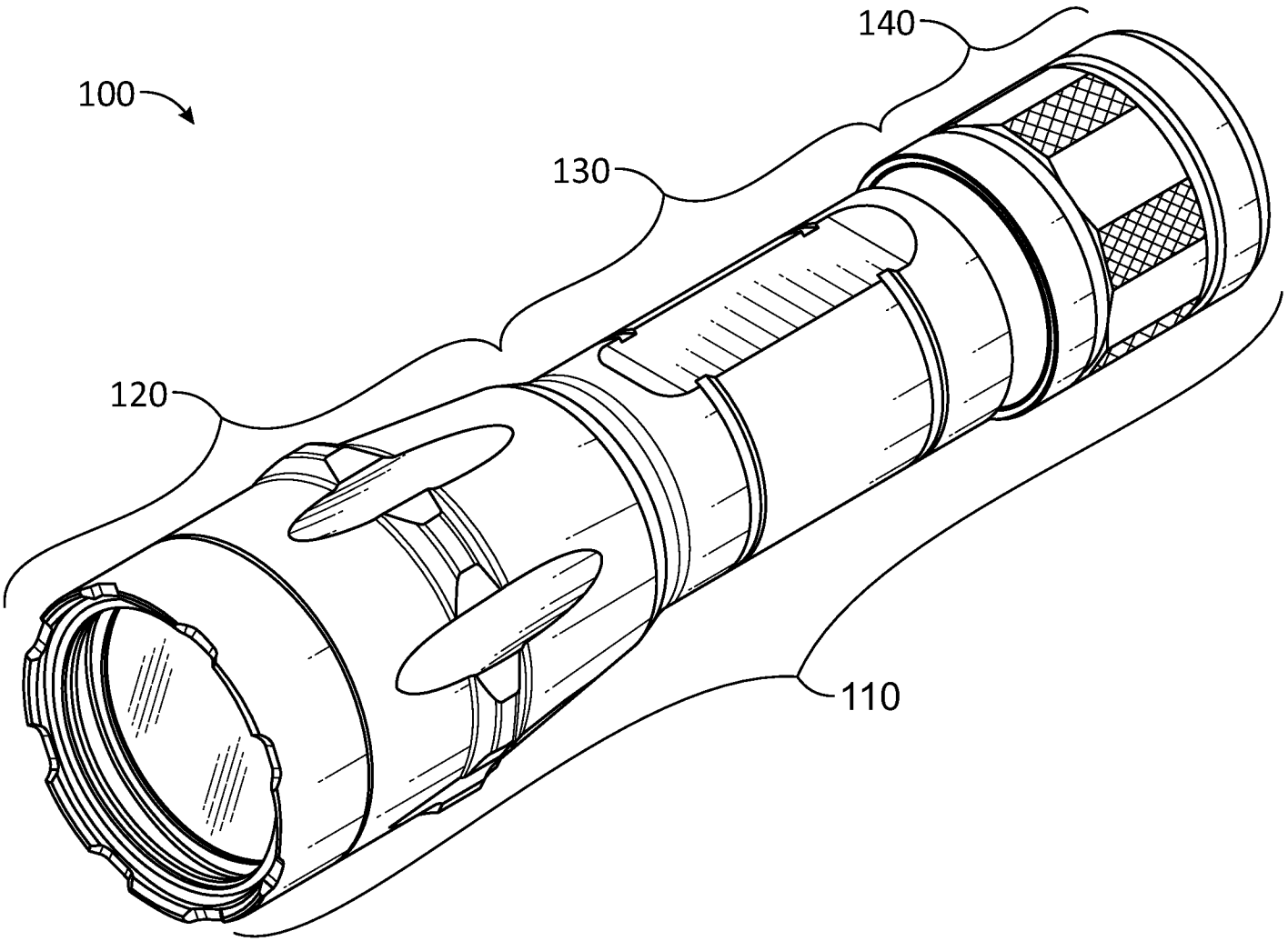
FIG. 1 illustrates an isometric view of a lighting device in accordance with an embodiment of the disclosure.
Figure 2:
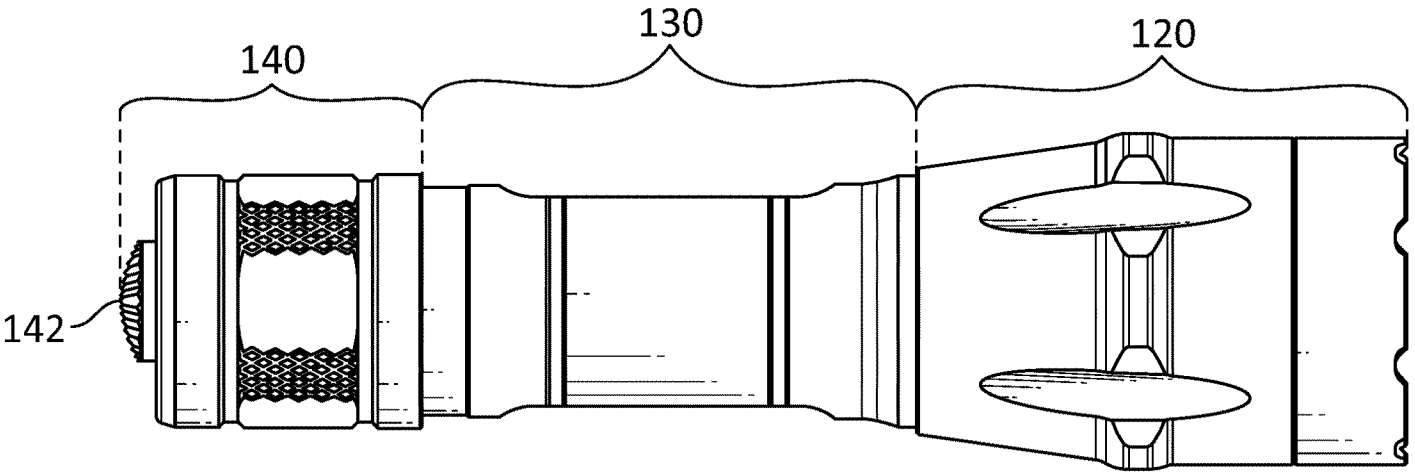
FIG. 2 illustrates a side view of a lighting device in accordance with an embodiment of the disclosure.

FIG. 1 illustrates an isometric view of a lighting device 100 and FIG. 2 illustrates a side view of lighting device 100 in accordance with embodiments of the disclosure. In some embodiments, lighting device 100 may be implemented as a portable lighting device such as a flashlight as shown. In other embodiments, other types of portable devices (e.g., not connected to external power sources) such as headlamps, helmet lights, and/or other devices are contemplated.

As shown, lighting device 100 includes a head 120, an intermediate portion 130, and a tailcap 140 having a user operable surface 142. External portions of these features collectively provide a body 110 (e.g., a housing) for lighting device 100. In some embodiments, body 110 may be implemented with conductive materials (e.g., aluminum or others) to provide one or more circuit paths between various components of lighting device 100.

Figure 3:
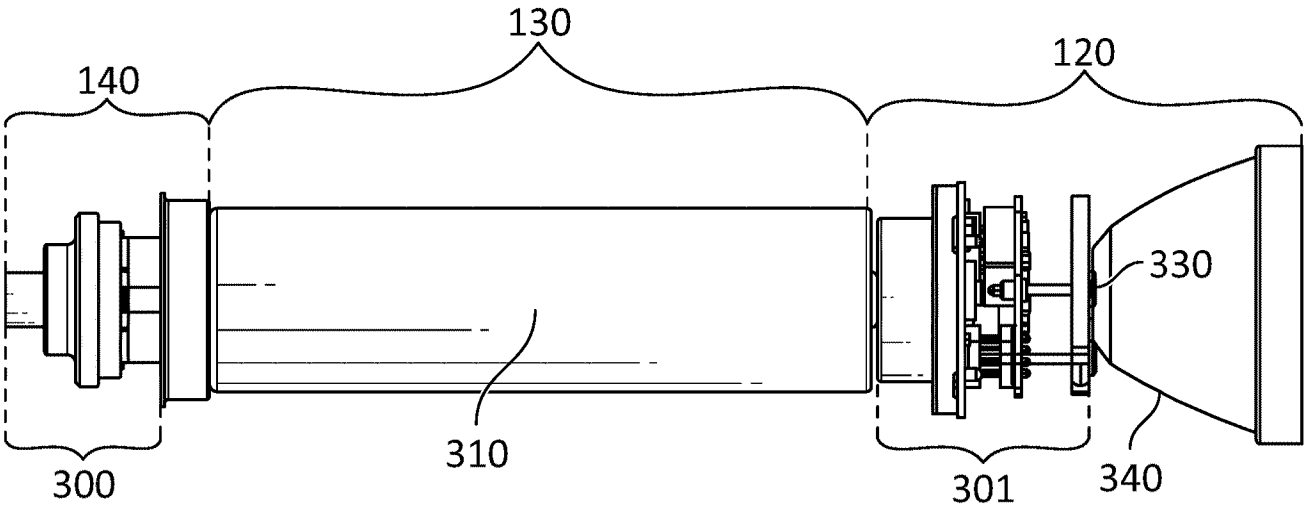
FIG. 3 illustrates a side view of a lighting device with housing removed in accordance with an embodiment of the disclosure.

FIG. 3 illustrates a side view of lighting device 100 with body 110 removed in accordance with an embodiment of the disclosure. With body 110 removed, various internal features of lighting device 100 are further visible. Head 120 includes head electronics 301, one or more light sources 330, and one or more lenses 340. Intermediate portion 130 includes a battery 310 or another appropriate power source enclosed therein. Tailcap 140 includes a switch assembly 300 with various components further discussed herein. Although switch assembly 300 is discussed in relation to a position within tailcap 140 which provides convenient access for a user, switch assembly 300 may be provided in other positions within or on lighting device 100 as appropriate.

Figure 4:
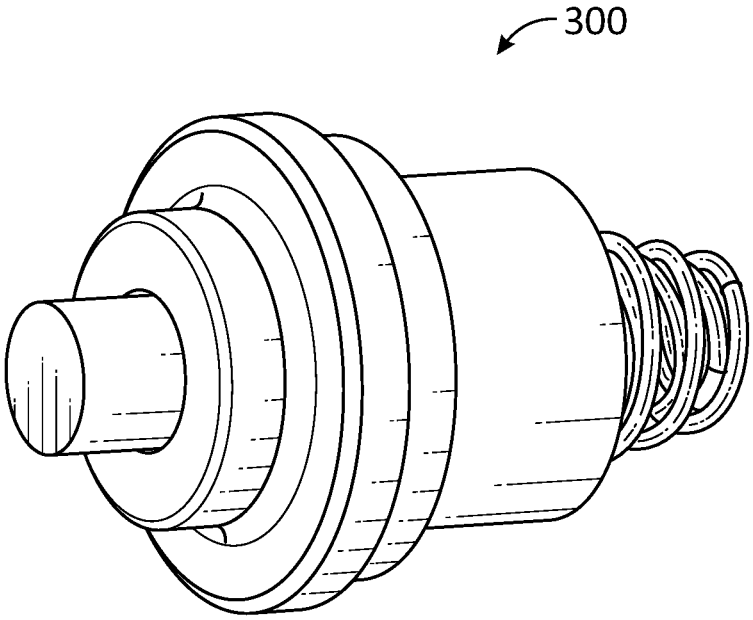
FIG. 4 illustrates an isometric view of a switch assembly in accordance with an embodiment of the disclosure.

FIG. 4 illustrates an isometric view of switch assembly 300 in accordance with an embodiment of the disclosure. As further discussed herein with regard to FIG. 6, switch assembly 300 provides a user operable mechanical switch 318 that may be selectively engaged and disengaged by a user to connect and a disconnect a control block 830 to and from body 110.

Figure 5:
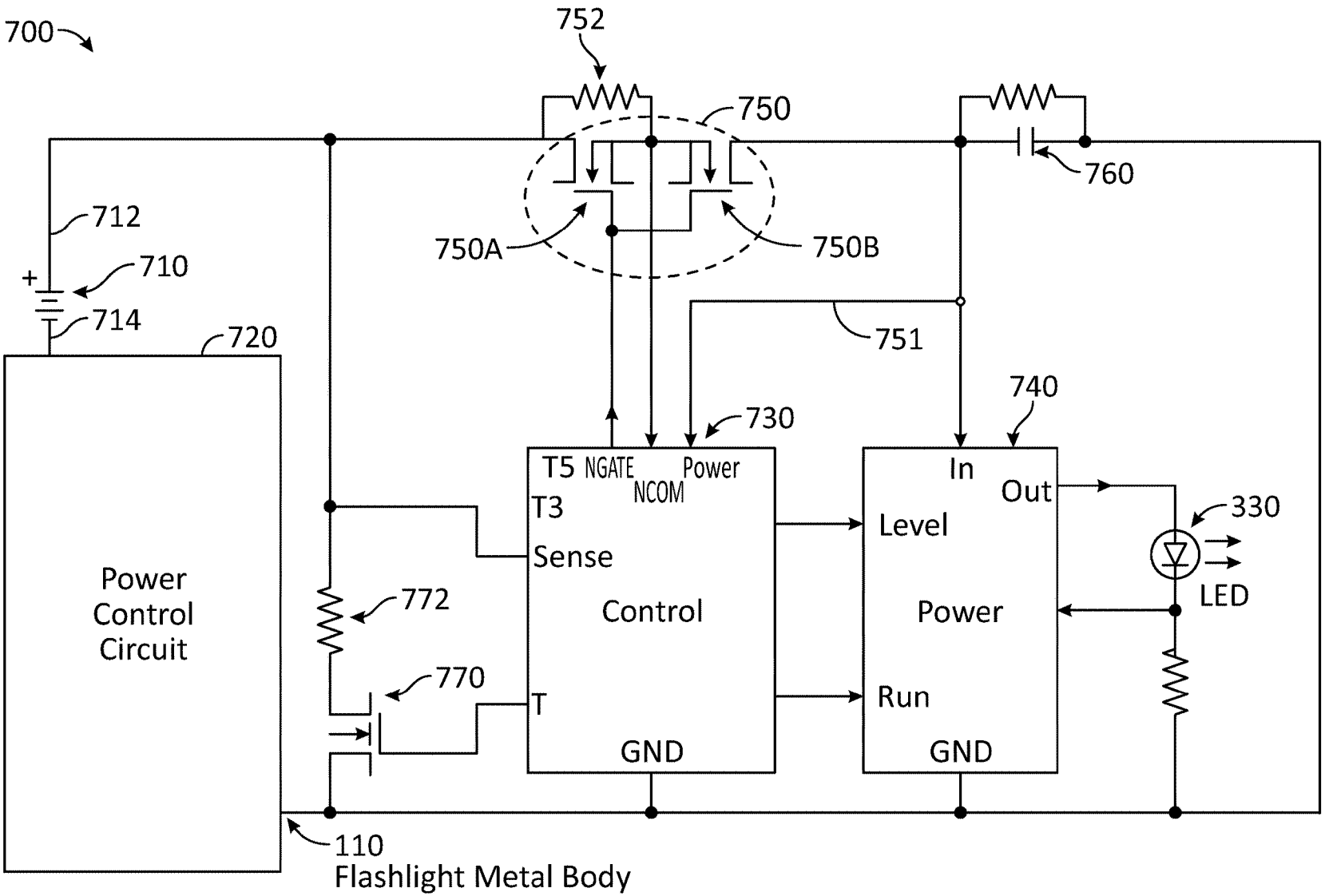
FIG. 5 illustrates a circuit diagram of a lighting device in accordance with an embodiment of the disclosure.

FIG. 5 illustrates a circuit diagram 700 of lighting device 100 in accordance with an embodiment of the disclosure. Other circuits may be used in other embodiments. Circuit diagram 700 includes light source 330, a battery 710, a power control circuit 720, additional components provided by head electronics 301 (e.g., a controller 730, a driver 740, electronic switches 750 such as transistors, a resistor 752, a capacitor 760, an electronic switch 770 such as a transistor, a resistor 772), and additional connections provided by body 110.

Battery 710 may be used to provide a power source (e.g., a voltage source) for the various components of lighting device 100 through a positive node 712 and a negative node 714. Power control circuit 720 may be used to selectively connect negative node 714 of battery 710 to body 110 to provide a return circuit path from light source 330 and other components to battery node 714. In addition, power control circuit 720 may include a user operable mechanical switch 318, a power transistor, an inductor, and other components further discussed herein.

Controller 730 may be implemented as a microcontroller, processor, and/or any appropriate logic device to provide appropriate control signals to operate driver 740, switches 750, and switch 770. In some embodiments, controller 730 may also be implemented to receive programming signals superimposed on node 712 (e.g., external programming signals providing configuration data to update the configuration and operation of controller 730).

Driver 740 receives control signals from controller 730 to selectively turn on (e.g., activate) and turn off (e.g., deactivate) light source 330. Switches 750 (e.g., individually labeled as 750A and 750B) may be implemented, for example, as transistors to selectively disconnect battery node 712 from driver 740 and capacitor 760, thus interrupting power from battery 710 to driver 740 and capacitor 760.

Resistor 752 and a parasitic diode in electronic switch 750B connects battery node 712 to controller 730, even when switches 750 are off which permits controller 730 to receive power (e.g., during startup or when switches 750 are temporarily disconnected while power control circuit 720 is pulsed through the selective connection and disconnection of a bypass circuit path in blocks 1430 and 1440 discussed herein).

Capacitor 760 is charged by battery 710 while switches 750 are closed and may be used to provide power to driver 740 while switches 750 are open. In this regard capacitor 760 is also referred to as a light source capacitor and a head capacitor.

Switch 770 (e.g., also referred to as a temporary switch) is selectively closed by controller 730 to periodically connect battery node 712 to body 110 through resistor 772, thus effectively shorting battery node 712 to body 110.

Figure 6:
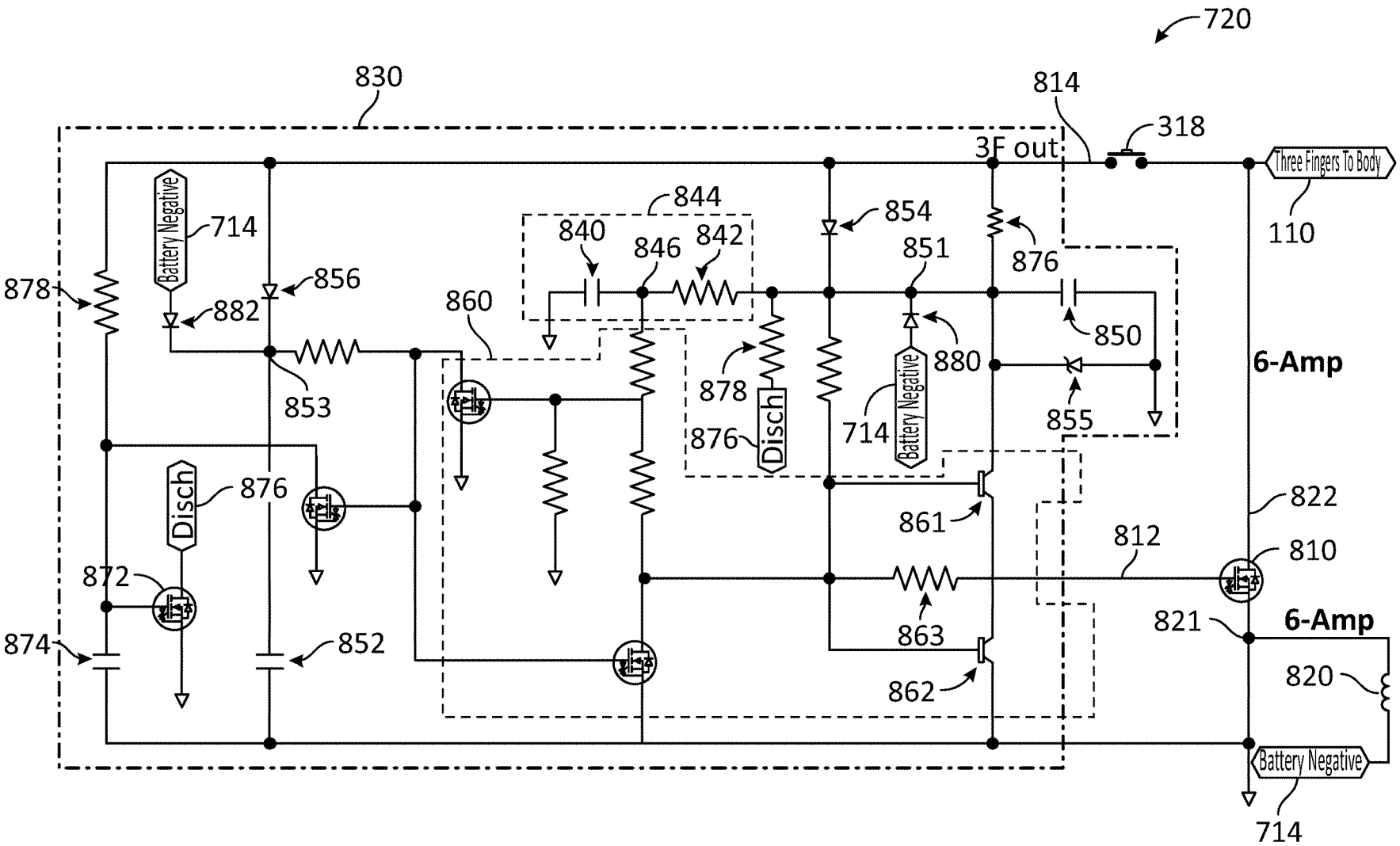
FIG. 6 illustrates a circuit diagram of a power control circuit of a lighting device in accordance with an embodiment of the disclosure.

FIG. 6 illustrates a circuit diagram of power control circuit 720 in accordance with an embodiment of the disclosure. As shown, power control circuit 720 includes mechanical switch 318, a power transistor 810 (e.g., a power MOSFET or other appropriate switch capable of reliably passing large currents greater than 3 Amps), an inductor 820, and a control block 830.

Mechanical switch 318 may be selectively closed and opened by a user to selectively connect control block 830 to body 110. Power transistor 810 passes current received from body 110 to provide a return path for high currents passed by light source 330 (e.g., operating currents) to permit high current operation without requiring such high currents to pass through mechanical switch 318.

Inductor 820 produces voltage spikes generated in response to the periodic shorting (e.g., connection) and unshorting (e.g., disconnection) of battery node 712 to body 110 as discussed herein. Control block 830 operates to selectively turn on and off power transistor 810 in response to the operation of mechanical switch 318 as discussed herein. Various components of control block 830 are discussed further herein in relation to the operation of power control circuit 720.

Figure 7:
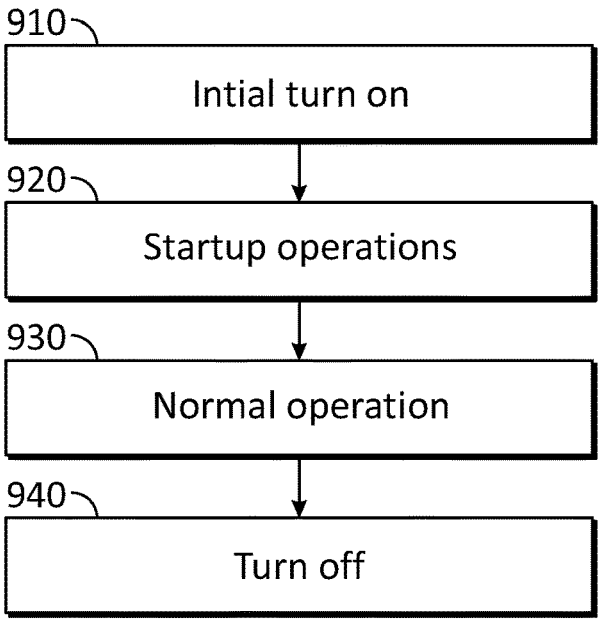
FIG. 7 illustrates a process of operating a power control circuit of a lighting device in accordance with an embodiment of the disclosure.

FIG. 7 illustrates a process of operating power control circuit 720 in accordance with an embodiment of the disclosure. In block 910, power control circuit 720 performs initial turn on operations to charge various capacitors and turn on power transistor 810 in response to a user's engagement of mechanical switch 318. In block 920, controller 730 performs startup operations to prepare light source 330 and power control circuit 720 for normal operation while mechanical switch 318 remains engaged. In block 930, controller 730 and power control circuit 720 perform normal operations to operate light source 330 and keep power transistor 810 turned on while mechanical switch 318 remains engaged. In block 940, power control circuit 720 performs turn off operations to discharge various capacitors and turn off power transistor 810 in response to the user's disengagement of mechanical switch 318. The operations of FIG. 7 will now be discussed in further detail in relation to the additional processes and plots illustrated in FIGS. 8 to 15.

Figure 8:
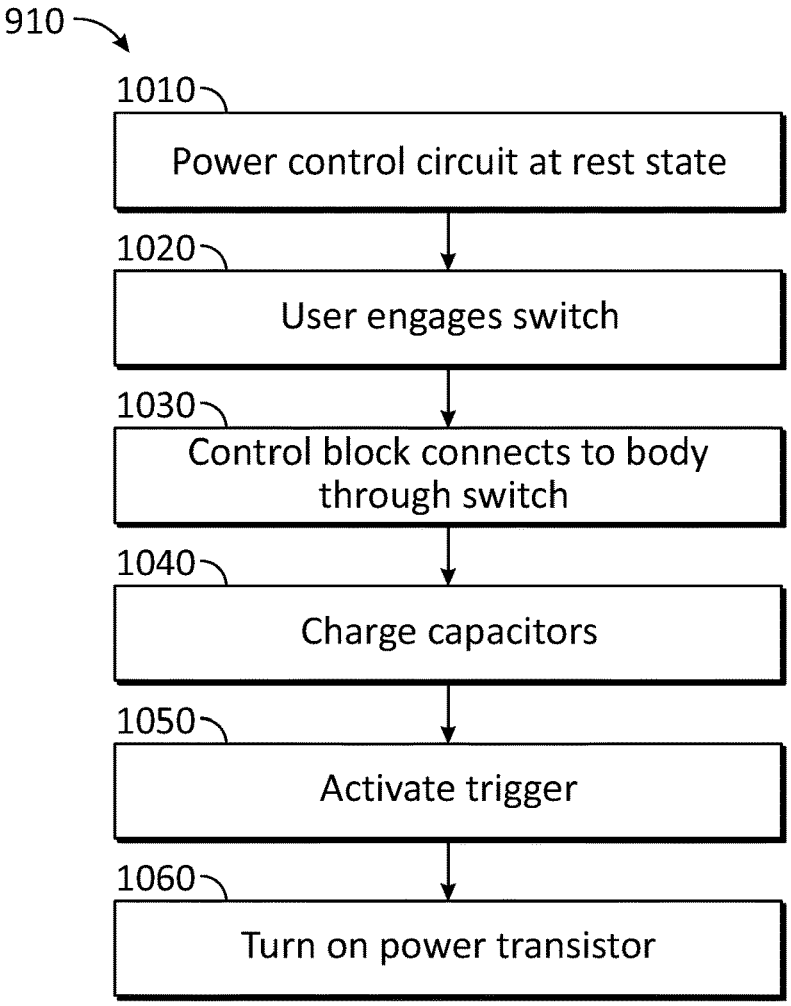
FIG. 8 illustrates an initial turn on process in accordance with an embodiment of the disclosure.
Figure 9:
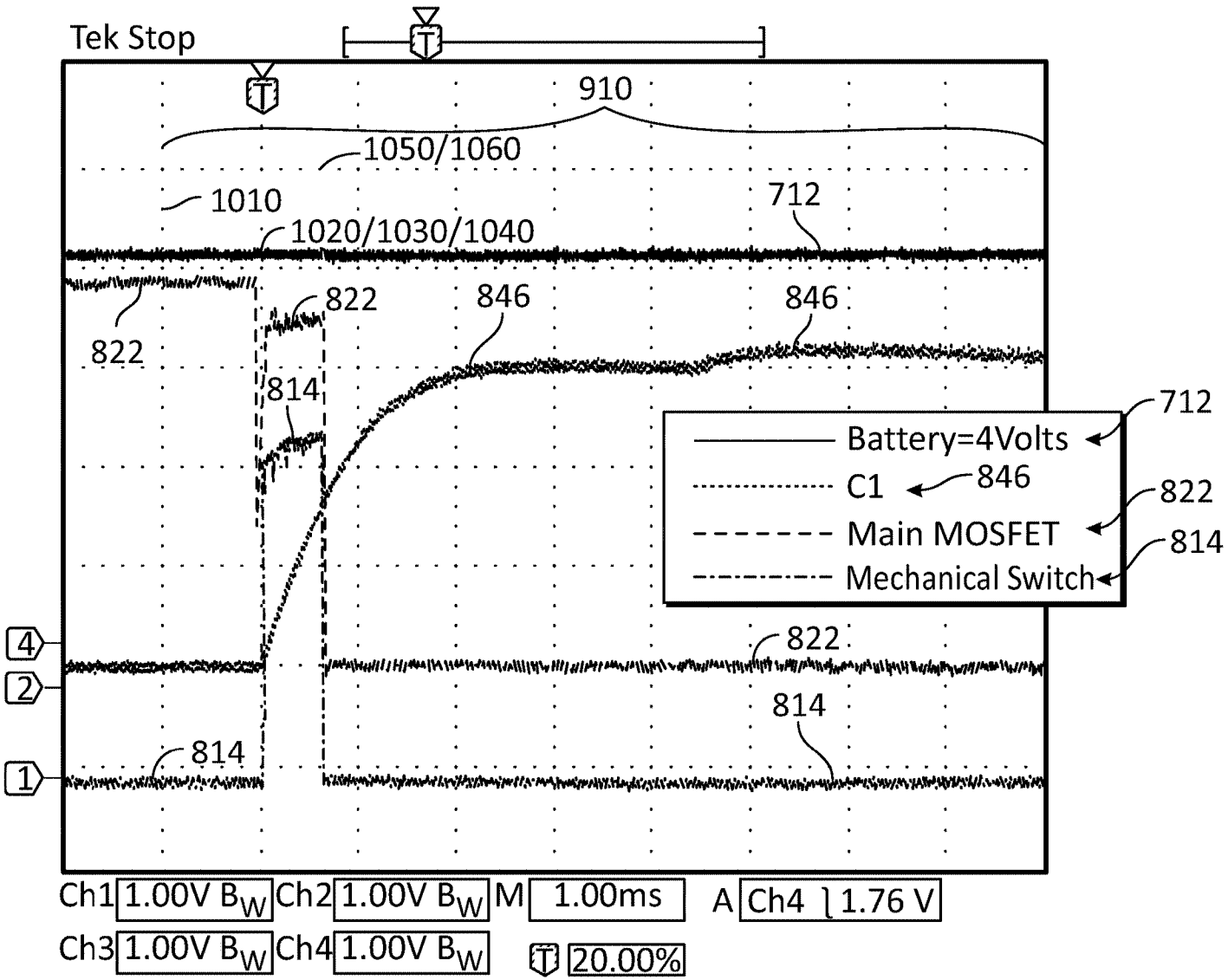
FIG. 9 illustrates voltage plots associated with the initial turn on process of FIG. 8 in accordance with an embodiment of the disclosure.

FIG. 8 illustrates an initial turn on process performed in block 910 of FIG. 7 and FIG. 9 illustrates voltage plots associated with the initial turn on process of FIG. 8 in accordance with embodiments of the disclosure. In particular, FIG. 9 provides voltage plots of node 712 of battery 710, node 846 of capacitor 840, node 822 of power transistor 810, and node 814 of mechanical switch 318. In FIGS. 9, 11, 13, and 15, the ground reference corresponds to node 714 shown in FIGS. 5 and 6.

In block 1010, power control circuit 720 is initially at a rest state with all capacitors discharged and power transistor 810 off. Also in block 1010, controller 730, driver 740, switches 750, switch 770, and light source 330 are off.

In block 1020, a user operates (e.g., engages) mechanical switch 318. This causes control block 830 to become electrically connected to body 110 (block 1030) and this provides initial voltage for control block 830. As shown in FIG. 9, this also causes the voltage at node 814 to rise (e.g., to over 3 volts) and the voltage at node 822 to fall.

In block 1040, the increased voltage at node 814 causes current to flow and begin charging capacitors 850 and 852 within microseconds. In some embodiments, capacitor 760 may be relatively large while capacitors 850 and 852 may be relatively small. As a result, the vast majority of the battery voltage (e.g., less the voltage drops of diodes 854 and 856 and additional components of circuit 700) will appear across capacitors 850 and 852 which is sufficient to begin operation of power control circuit 720.

Referring further to FIG. 9, the voltage on node 822 falls, and the voltage on node 814 rises in response to the user's engagement of mechanical switch 318 at block 1020. In this regard, prior to block 1020, node 822 exhibits a voltage that corresponds to the voltage across power transistor 810. Also prior to block 1020, head capacitor 760 is discharged and electronic switches 750 have little voltage drop. As a result, close to the full voltage of battery 710 appears at node 822. In addition, one side of mechanical switch 318 is connected to control block 830 at node 814. When mechanical switch 318 is closed, the voltage on node 822 rushes into node 814, and in turn through the diodes 854 and 856, charging capacitors 840 and 852, respectively. This charging of capacitors 840 and 852 accounts for the dip in the voltage of node 822 voltage at block 1020/1030/1040 (e.g., lasting for several tens of microseconds) as shown in FIG. 9. As also shown in FIG. 9, the voltage at node 814 ramps up (e.g., as an RC exponential curve) to about 3.0 volts in response to the initial rush of voltage and then rises more slowly because of the nonlinear effect of the diode drop associated with electronic switches 750.

As shown in FIG. 6, an RC circuit 844 is provided by capacitor 840 and resistor 842 having an associated RC time constant. As a result, capacitor 840 will charge more slowly than capacitors 850 and 852 (e.g., capacitor 840 will exhibit a charging delay due to an RC time constant associated with the combination of capacitor 840 and resistor 842). In this regard, as further shown in FIG. 9, capacitor 840 continues to charge (e.g., up to approximately 3 volts) even after power transistor 810 turns on and removes all available charging voltage through the mechanical switch.

In block 1050, after capacitors 840, 850, and 852 are sufficiently charged (e.g., above a threshold of 1.6 volts across capacitor 840), this will be sufficient to activate a Schmitt trigger circuit 860. As a result, the Schmitt trigger circuit 860 will provide a voltage through a voltage follower circuit (e.g., provided by a transistor 861, a transistor 862, and a resistor 863) to gate 812 to turn on power transistor 810 (block 1060). As discussed, capacitor 840 may charge more slowly due to an RC time constant. This serves to delay the activation of Schmitt trigger circuit 860 during the turn on process of FIG. 8 to ensure that control block 830 has much more than the minimum voltage to operate before power transistor 810 is turned on.

The current flow through mechanical switch 318 can be further understood as follows. When mechanical switch 318 is closed in block 1020, a current pulse (e.g., under 0.5 Amps limited by resistor 722) flows for several 10's of microseconds from body 110 through mechanical switch 318 to control block 830 to charge capacitors 840 and 850. After capacitors 840 and 850 are charged, the current through mechanical switch 318 drops to less than one milliamp until power transistor 810 turns on several milliseconds later (block 1060). After power transistor 810 turns on, the current through mechanical switch 318 reverses to 3 to 5 micro-Amps DC in the opposite direction from control block 830 to power transistor 810 with no pulse current. The pulse current instead flows directly from inductor 820 through diodes 880 and 882 to capacitors 840 and 850.

Figure 10:
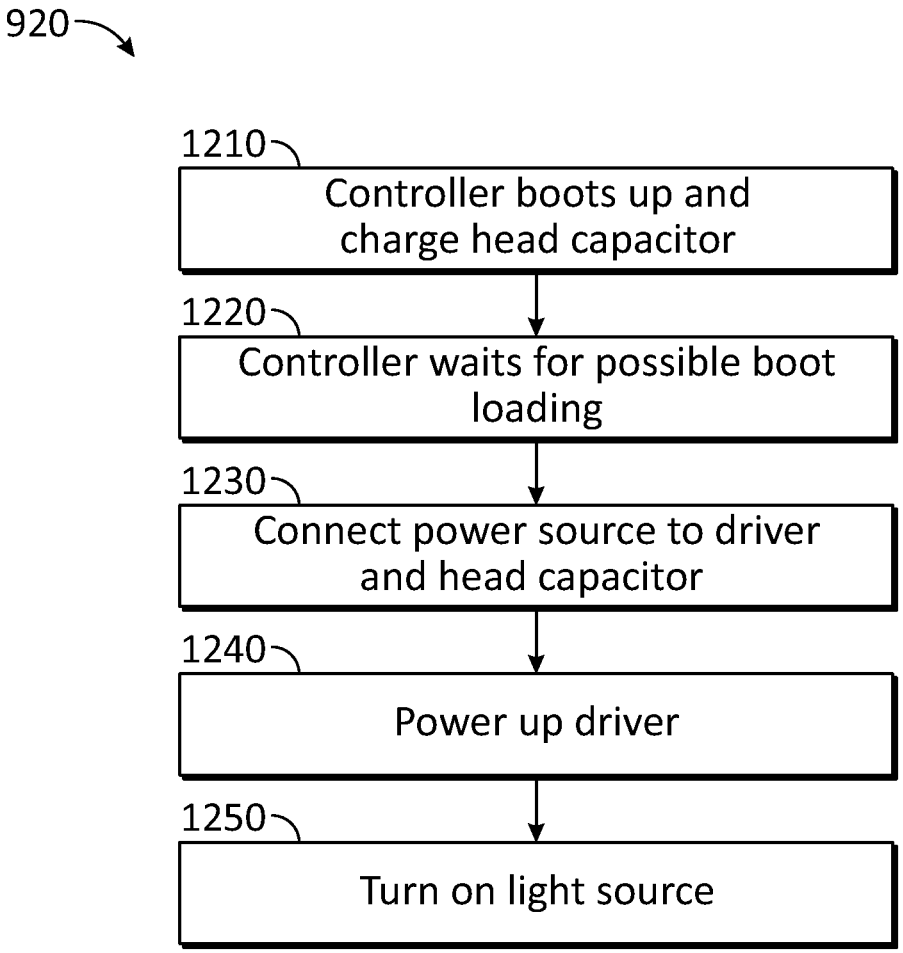
FIG. 10 illustrates an operational start up process in accordance with an embodiment of the disclosure.
Figure 11:
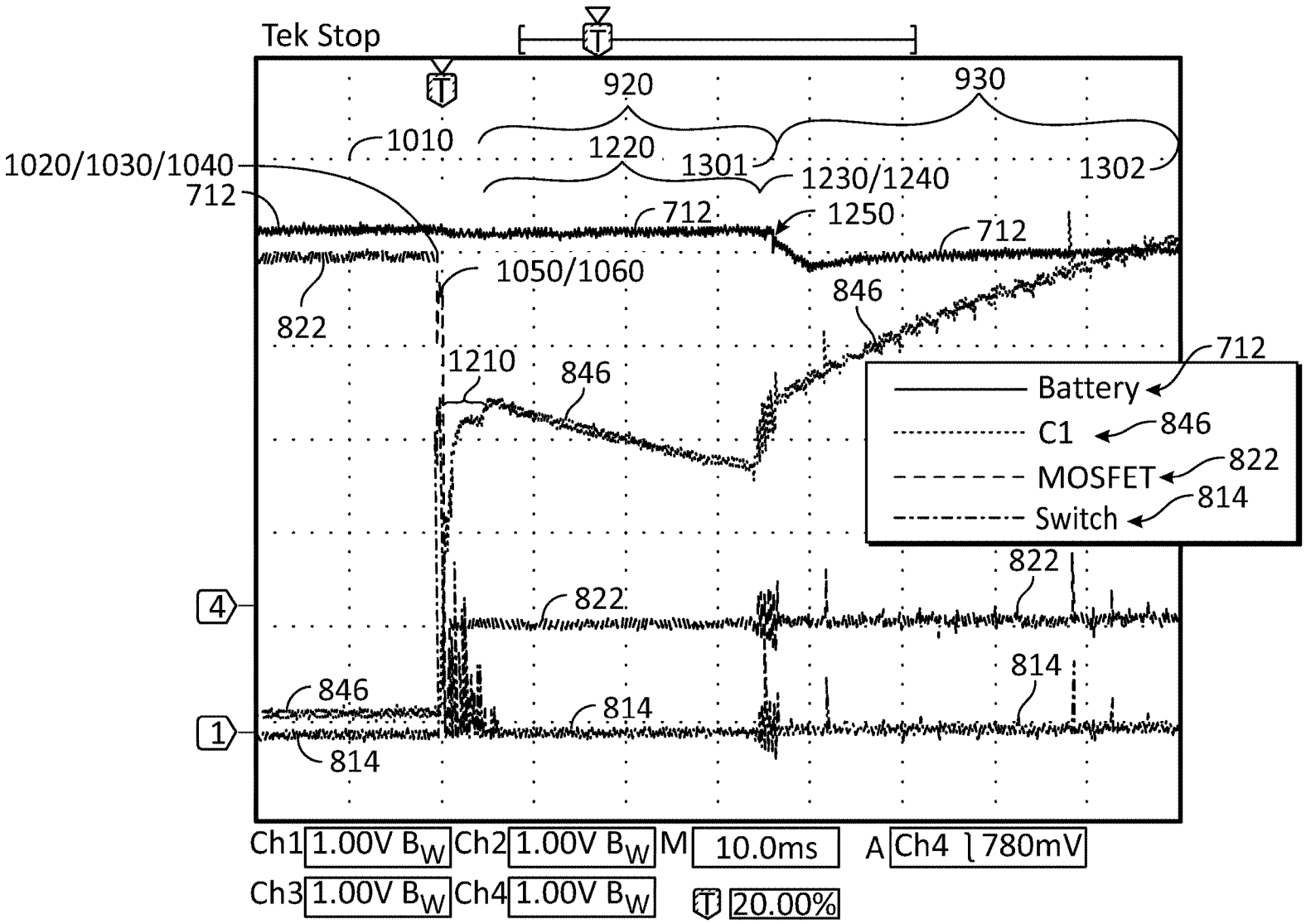
FIG. 11 illustrates voltage plots associated with the operational start up process of FIG. 10 in accordance with an embodiment of the disclosure.

FIG. 10 illustrates a startup operations process performed in block 920 of FIG. 7 and FIG. 11 illustrates voltage plots associated with the startup process of FIG. 10 accordance with embodiments of the disclosure. As shown, the voltage plots of FIG. 11 are associated with the nodes discussed with regard to FIG. 9.

In block 1210, controller 730 receives power from battery 710 through the closed power transistor 810, the metal body 110, the resistor 752, and the parasitic diode inside electronic switch 750B. This allows the head capacitor 760 to charge up to nearly the full voltage of battery 710. This voltage is routed into controller 730 through power connection 751 causing internal logic of controller 730 to boot up (e.g., become operational). In block 1220, controller 730 waits (e.g., for approximately 30 milliseconds after block 1210) to receive possible serial data superimposed on battery node 712 and received by the "SENSE" input to possibly reconfigure controller 730. In this regard, controller 730 may be reprogrammed (e.g., reconfigured) through serial data pulsed on node 712 (e.g., through a connection to an external device) if desired. As shown in FIG. 11, during block 1220, node 846 associated with capacitor 840 may fall approximately 0.5 volts as the various capacitors of power control circuit 720 are not being charged during block 1220 while the various components of power control circuit 720 operate during the startup operations process.

In block 1230 (e.g., approximately 32 milliseconds after block 1020), controller 730 turns on switches 750 to connect battery 710 to driver 740 and capacitor 760. In block 1240, capacitor 760 is connected to the full battery voltage and driver 740 receives full power as a result of the turning on of switches 750. In block 1250, controller 730 provides a control signal to driver 740 to turn on light source 330. Also at this time, the operation of a boost converter within controller 730 may cause a temporary boost in voltage provided to power control circuit 720. As shown in FIG. 11, following block 1250, normal operation begins corresponding to block 930 of FIG. 7 (e.g., approximately 36 milliseconds after block 1020) as discussed herein.

Figure 12:
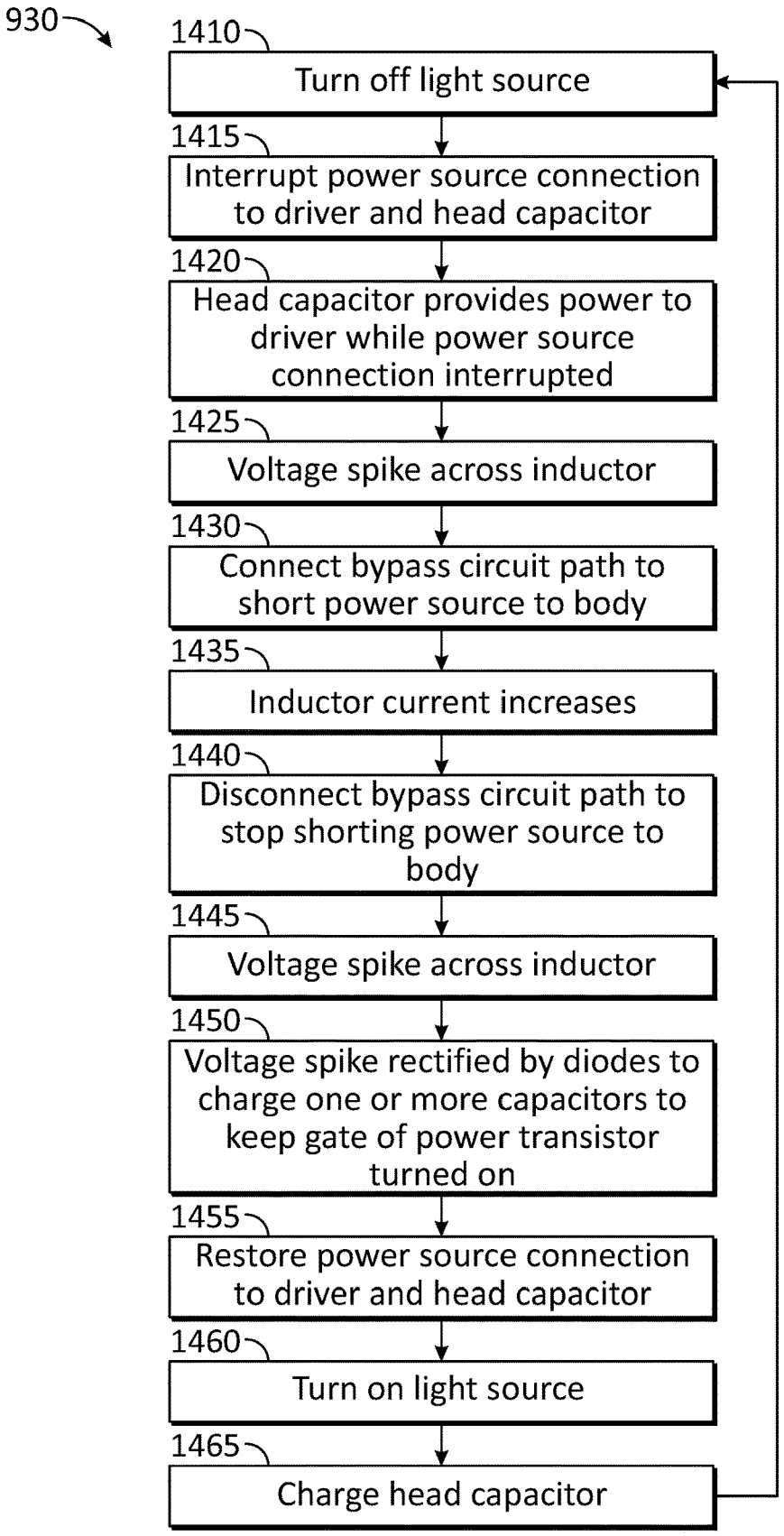
FIG. 12 illustrates a normal operation process in accordance with an embodiment of the disclosure.
Figure 13:
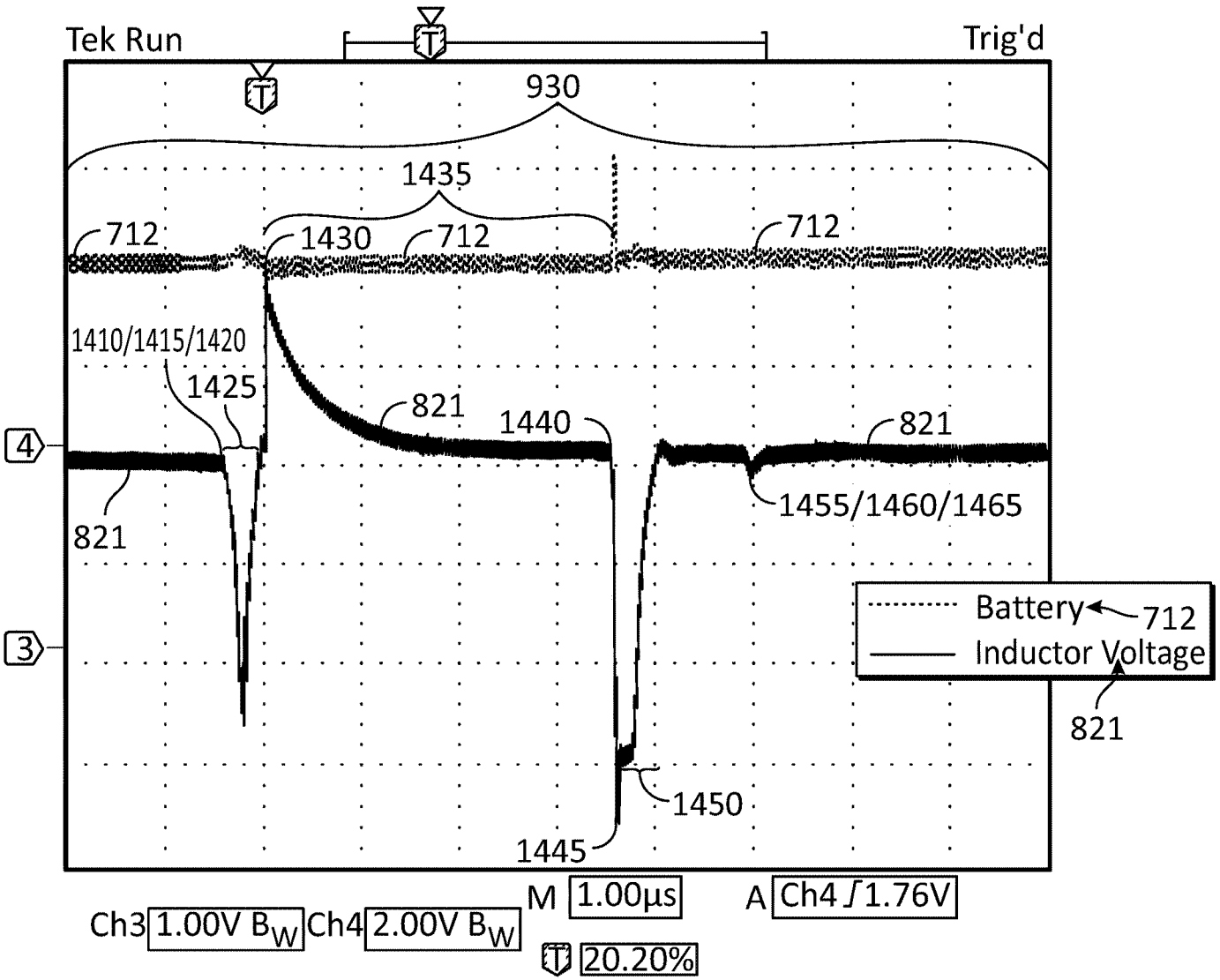
FIG. 13 illustrates voltage plots associated with the normal operation process of FIG. 12 in accordance with an embodiment of the disclosure.

FIG. 12 illustrates a normal operation process performed in block 930 of FIG. 7 and FIG. 13 illustrates voltage plots associated with the normal operation process of FIG. 12 in accordance with embodiments of the disclosure. In particular, FIG. 13 provides voltage plots of node 712 of battery 710 and node 821 of inductor 820.

In block 1410, controller 730 provides a control signal to driver 740 to turn off light source 330. In block 1415, controller 730 turns off switches 750 to interrupt (e.g., disconnect) the electrical connection from battery 710 to driver 740 and capacitor 760. As discussed, capacitor 760 was previously charged (e.g., beginning in block 1240). Accordingly, in block 1420, capacitor 760 may operate to temporarily supply power to driver 740 and light source 330 while switches 750 are off.

In block 1425, the voltage at inductor node 821 briefly spikes as the current through inductor 820 drops from full operating current (e.g., while light source 330 was powered) down to zero as a result of the turning off of light source 330 (e.g., block 1410) and/or the turning off of switches 750 (e.g., block 1420).

In block 1430, controller 730 closes switch 770 to connect battery node 712 to body 110 through resistor 772. In some embodiments, resistor 772 may be implemented with a relatively low value, which effectively causes a short from battery node 712 to body 110 through resistor 772 and switch 770. As a result, a temporary bypass circuit path is connected between nodes 712 and 714 comprising resistor 772, switch 770, body 110, power transistor 810, and inductor 820 (e.g., power transistor 810 and inductor 820 are provided by power control circuit 720).

In block 1435, as a result of the shorting of battery node 712 to body 110, the current through inductor 820 increases (e.g., up to 3 to 4 Amps associated with a battery voltage of 3 to 4 volts in some embodiments). This is evidenced in FIG. 13 by the falling voltage at node 821.

In block 1440 (e.g., 3.5 microseconds after block 1430), controller 730 opens switch 770 to interrupt the short from battery node 712 to body 110 through resistor 772 and switch 770 (e.g., the temporary bypass circuit path is disconnected between nodes 712 and 714). In block 1445, a voltage spike is induced across inductor 820 as a result of the opening of switch 770 and resulting change in current through inductor 820.

In block 1450, the voltage spike is rectified by diodes 880 and 882 to charge capacitors 850 and 852. This additional charging of capacitors 850 and 852 causes nodes 851 and 853 to be maintained at sufficient voltages to keep Schmitt trigger circuit 860 activated to provide sufficient voltage to gate 812 to keep power transistor 810 turned on until the next iteration of the process of FIG. 12.

For example, in the case of change in current of 3 Amps decaying to zero in 200 nanoseconds, approximately 300 nano-Coulombs of charge may be provided for capacitors 850 and 852. By repeating the process of FIG. 12 every millisecond (e.g., a repeat rate of 1 KHz or several KHz), 300 uA of operating current can be passed by inductor 820 to power control circuit 720. As a result, capacitors 850 and 852 can be repeatedly charged to maintain sufficient voltage to keep Schmitt trigger circuit 860 activated and thus keep power transistor 810 turned on during normal operation block 930.

In block 1455 (e.g., 5 microseconds after block 1430), controller 730 turns on switches 750 to restore (e.g., reconnect) the electrical connection from battery 710 to driver 740 and capacitor 760. In block 1460, controller 730 provides a control signal to driver 740 to turn on light source 330. In block 1465, capacitor 760 begins charging again and driver 740 receives power as a result of the turning on of switches 750.

As shown, the process of FIG. 12 may be performed in an iterative fashion (e.g., repeatedly in a loop) during block 930 of FIG. 7. For example, in some embodiments, the process of FIG. 12 may be repeated every 1 millisecond. By continuing to repeat the process of FIG. 12, capacitors of power control circuit 720 can be repeatedly charged (e.g., refreshed with 300 uA of operating current as discussed) in order to keep power transistor 810 turned on while mechanical switch 318 is engaged.

For example, referring again to FIG. 11, this loop of repeated charging of the various capacitors of power control circuit 720 is demonstrated by the repeated quick increase and slow decrease in the voltage of node 846 of capacitor 840 during the repeated iterations of block 930 extending from time 1301 to time 1302. As also shown in FIG. 11, this process may provide a net increase in the voltage at node 846 (e.g., which increases to over 5.0 volts within 80 milliseconds after block 1020). The maximum voltage increase is limited by Zener diode 855.

Figure 14:
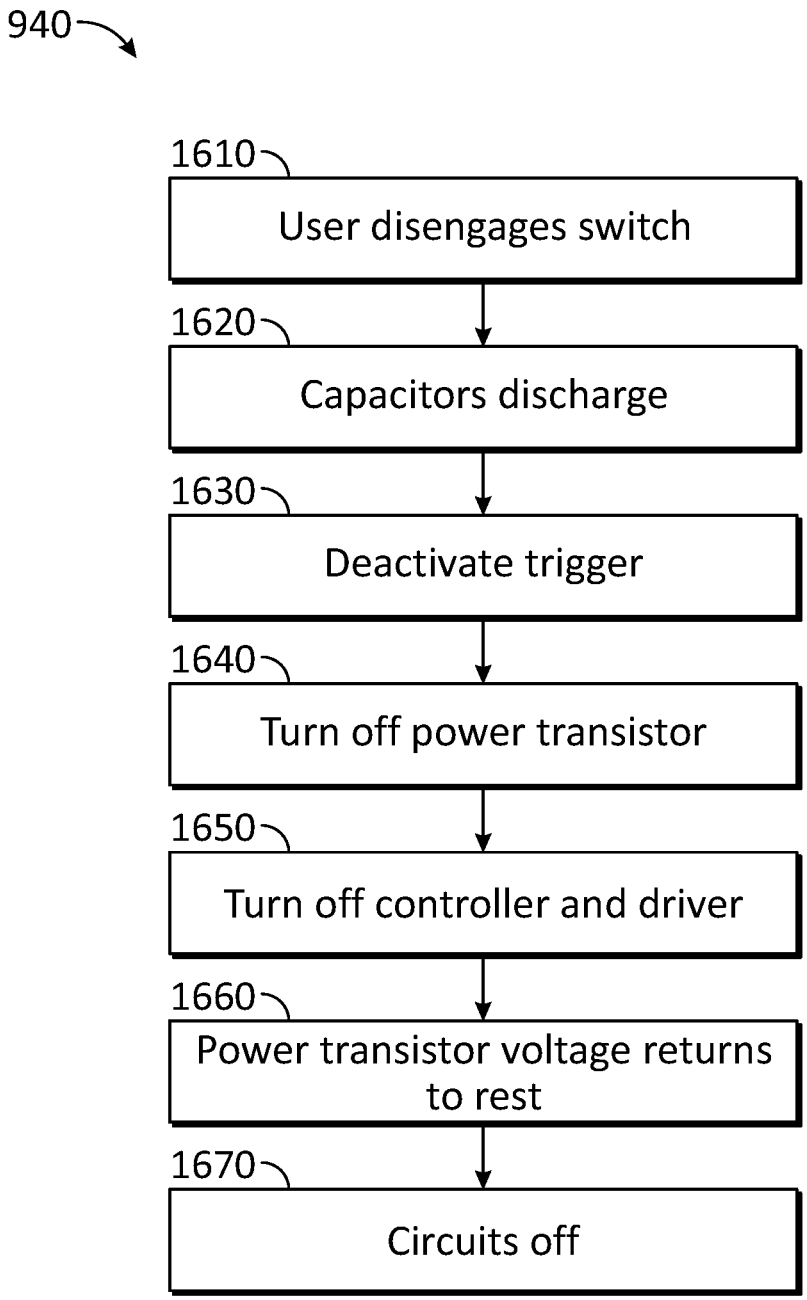
FIG. 14 illustrates a turn off process in accordance with an embodiment of the disclosure.
Figure 15:
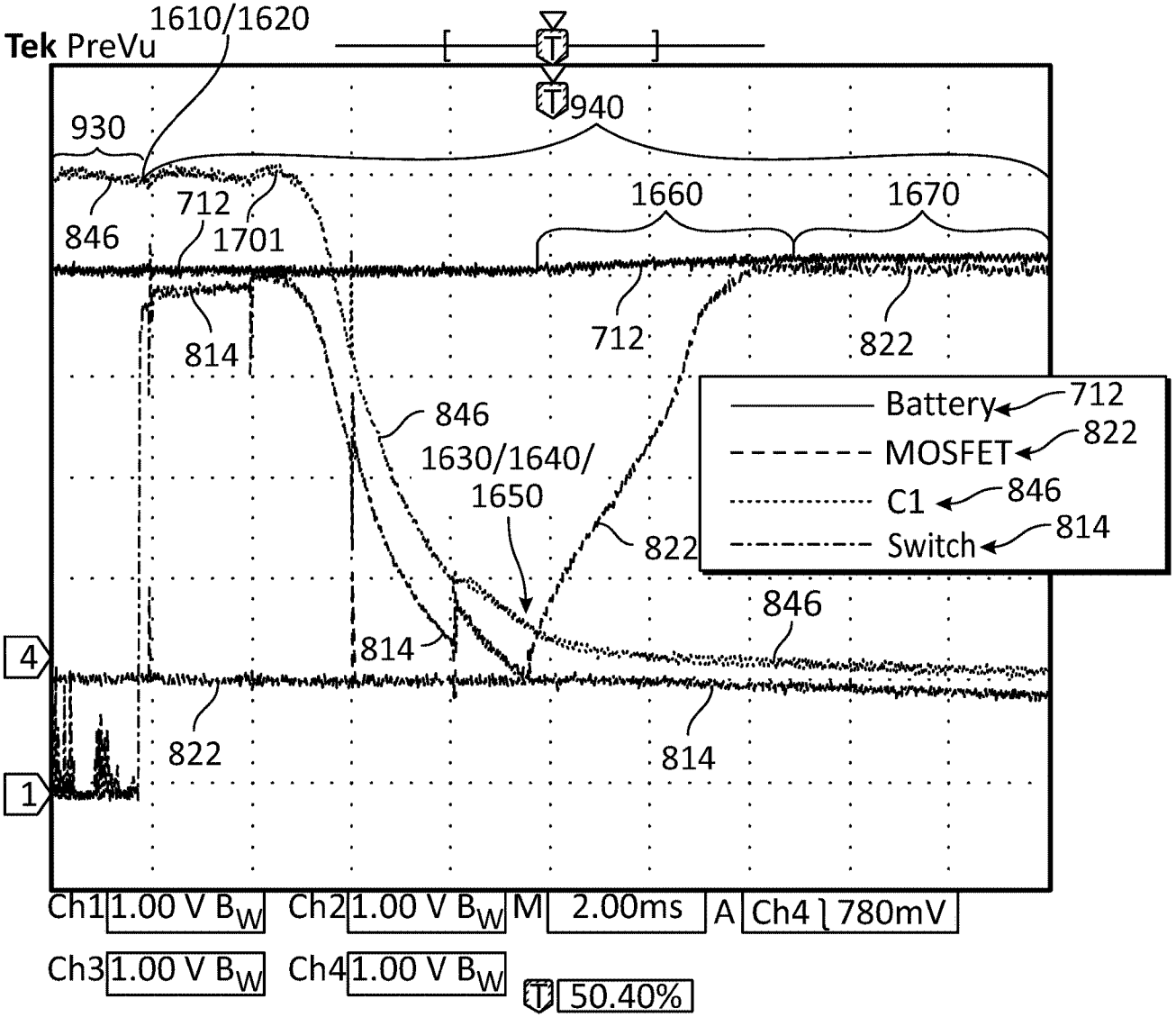
FIG. 15 illustrates voltage plots associated with the turn off process of FIG. 14 in accordance with an embodiment of the disclosure.

FIG. 14 illustrates a turn off process performed in block 940 of FIG. 7 and FIG. 15 illustrates voltage plots associated with the turn off process of FIG. 14 accordance with embodiments of the disclosure. As shown, the voltage plots of FIG. 15 are associated with the nodes discussed with regard to FIGS. 9 and 11.

At block 1610, the user disengages mechanical switch 318 which interrupts the connection between power control circuit 720 and body 110. At block 1620, capacitors 840 and 850 begin to discharge. In this regard, capacitor 850 provides a current through resistor 876 as evidenced by the voltage change at node 814 shown in FIG. 15. This current also flows through resistor 878 to charge up capacitor 874 which causes switch 872 to turn on within several milliseconds. When switch 872 turns on, capacitor 850 discharges through resistor 878, node 876, and switch 872. Also, capacitor 840 discharges indirectly through resistor 842, resistor 878, node 876, and switch 872. For example, as shown in FIG. 15, the voltage at node 846 of capacitor 840 begins dropping at time 1701.

At block 1630, after the voltages of capacitors 840 and 850 are sufficiently discharged, Schmitt trigger circuit 860 is deactivated. As a result, in block 1640, the voltage at gate 812 is driven below the threshold voltage of power transistor 810 which turns off.

When power transistor 810 is off and mechanical switch 318 is disengaged, then there is no longer a circuit path between battery node 714 and body 110. As a result, in block 1650, the rest of circuit 700 slowly loses voltage including controller 730, driver 740, light source 330, and other components.

In block 1660, the voltage at node 822 gradually returns to a rest voltage slightly below that of battery 710. Accordingly, at block 1670, power control circuit 720 and all components of circuit 700 are turned off and the lighting device 100 is completely turned off because they no longer have sufficient voltage to operate (e.g., the voltage of head capacitor 760 decreases to a point where all circuit operations cease).

In view of the present disclosure, it will be appreciated that by periodically connecting and disconnecting battery node 712 to body 110 (e.g., through a small resistor 772 and switch 770), currents can be rapidly introduced to and removed from inductor 820 which results in voltage spikes appearing across inductor 820. These voltage spikes are rectified by diodes 880 and 882 to charge capacitors 850 and 852 to keep Schmitt trigger circuit 860 activated and thus keep power transistor 810 turned on. As a result, power transistor 810 remains available to pass large currents associated with light source 330 (e.g., a majority, substantially all, or all of the operating current associated with light source 330) without requiring mechanical switch 318 to pass them. For example, in some embodiments, diodes 880 and 882 may pass small currents averaging approximately 100 uA to 200 uA (e.g., 8 mA to 16 mA RMS) in comparison with up to 6 Amps passed by power transistor 810, and mechanical switch 318 may pass only approximately 3 to 5 microamps DC with no pulse current at all during normal operation (e.g., mechanical switch 318 may pass approximately one millionth of the current passed by power transistor 810).

As a result, the heating experienced by mechanical switch 318 will be small, thus increasing its reliability in comparison to conventional designs where larger currents are required to pass through the mechanical switches without the aid of a power transistor to pass the majority of the current instead. Accordingly, lighting device 100 may be operated with one or more large current light sources 330 while still being controlled by a relatively small mechanical switch 318 that does not require specialized materials or bulk associated with passing large currents. Moreover, such an approach permits the use of a power transistor 810 to be operated in the tailcap 140 or other remote portion of the lighting device 100 without requiring an additional dedicated control circuit path (e.g., through a conductive sleeve or other implementation) for operating the power transistor 810.

Although multiple capacitors have been discussed, any desired number of capacitors may be used in various embodiments. For example, in some cases, a single capacitor may be used to keep power transistor 810 turned on.

Where applicable, various embodiments provided by the present disclosure can be implemented using hardware, software, or combinations of hardware and software. Also where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice-versa.

Software in accordance with the present disclosure, such as program code and/or data, can be stored on one or more computer readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A lighting device comprising:
a light source; and
a power control circuit comprising:
an inductor,
a power transistor configured to pass an operating current associated with the light source, and
one or more capacitors configured to keep the power transistor turned on to pass the operating current, wherein the one or more capacitors are configured to be periodically charged in response to a voltage spike generated across the inductor.

2. The lighting device of claim 1, further comprising:
a bypass circuit path; and
a controller configured to selectively connect and disconnect the bypass circuit path between first and second nodes of a power source of the lighting device.

3. The lighting device of claim 2, further comprising a conductive body, wherein the bypass circuit path comprises:
a temporary switch configured to be closed by the controller to pass a temporary current through the bypass circuit path and opened by the controller to interrupt the temporary current;
the power control circuit; and
the conductive body.

4. The lighting device of claim 3, wherein the voltage spike is generated by a change in the temporary current through the inductor caused by operation of the temporary switch.

5. The lighting device of claim 3, wherein the controller is configured to selectively disconnect the light source from the power source before the temporary switch is closed and connect the light source to the power source after the temporary switch is opened.

6. The lighting device of claim 3, wherein the controller is configured to operate the temporary switch at a frequency of approximately 1 KHz.

7. The lighting device of claim 2, further comprising the power source implemented by a battery.

8. The lighting device of claim 1, wherein the power control circuit further comprises:
a mechanical switch configured to selectively turn on and turn off the lighting device in response to a manipulation by a user; and
wherein the operating current passed by the power transistor is greater than a current passed by the mechanical switch while the light source is on.

9. The lighting device of claim 1, wherein the power control circuit further comprises:
a trigger circuit configured to turn on the power transistor in response to the charged one or more capacitors; and
an RC circuit configured to delay the turn on performed by the trigger circuit.

10. The lighting device of claim 1, wherein the lighting device is a flashlight, wherein the light source is positioned in a head end of the flashlight and the power control circuit is positioned in a tailcap of the flashlight.

11. A method comprising:
activating a light source of a lighting device comprising:
the light source, and
a power control circuit comprising an inductor, a power transistor, and one or more capacitors;
passing, by the power transistor, an operating current associated with the light source;
periodically generating a voltage spike across the inductor; and charging the one or more capacitors in response to the voltage spike to keep the power transistor turned on to continue the passing.

12. The method of claim 11, wherein the lighting device further comprises a bypass circuit path, a controller, and a power source, wherein the generating comprises:

connecting, by the controller, the bypass circuit path between first and second nodes of the power source; and disconnecting, by the controller, the bypass circuit path to generate the voltage spike.

13. The method of claim 12, wherein:

the bypass circuit path comprises a temporary switch, the power control circuit, and a conductive body of the lighting device;

the connecting comprises closing, by the controller, the temporary switch to pass a temporary current through the bypass circuit path; and the disconnecting comprises opening, by the controller, the temporary switch to interrupt the temporary current.

14. The method of claim 13, wherein the voltage spike is generated in response to a change in the temporary current through the inductor caused by the disconnecting of the temporary switch.

15. The method of claim 13, further comprising:

disconnecting, by the controller, the light source from the power source before the closing of the temporary switch; and connecting, by the controller, the light source to the power source after the opening of the temporary switch.

16. The method of claim 13, wherein the connecting and the disconnecting are performed at a frequency of approximately 1 KHz.

17. The method of claim 12, wherein the power source is implemented by a battery.

18. The method of claim 11, wherein:

the power control circuit further comprises a mechanical switch;

the method further comprises:

receiving a manipulation by a user at the mechanical switch, and performing the activating in response to the manipulation; and the operating current passed by the power transistor is greater than a current passed by the mechanical switch while the light source is activated.

19. The method of claim 11, wherein the power control circuit further comprises a trigger circuit and an RC circuit, the method further comprising;

charging the RC circuit; and activating the trigger circuit to turn on the power transistor following a delay associated with the RC circuit.

20. The method of claim 11, wherein the lighting device is a flashlight, wherein the light source is positioned in a head end of the flashlight and the power control circuit is positioned in a tailcap of the flashlight.

* * * * *